US005350246A

United States Patent [19]

Sehringer

[11] Patent Number: 5,350,246

[45] Date of Patent: Sep. 27, 1994

[54] HIGH SPEED CONTINUOUS-FORMS PRINTER

[75] Inventor: Lawrence T. Sehringer, Vestal, N.Y.

[73] Assignee: International Business Machines Corporation, Armonk, N.Y.

[21] Appl. No.: 924,136

[22] Filed: Aug. 3, 1992

[51] Int. Cl.[5] ..... B31B 1/96; B41J 11/58

[52] U.S. Cl. ..... 400/613.2; 493/410; 493/413; 493/461; 400/613.3; 400/619

[58] Field of Search ..... 493/410, 413, 460, 461, 493/448; 400/613.2, 611, 613, 619, 613.3

[56] References Cited

U.S. PATENT DOCUMENTS

| | | | |
|---|---|---|---|
| 2,779,450 | 1/1957 | Mecum et al. | 493/410 |
| 2,906,527 | 9/1959 | Blain | 493/411 |
| 3,807,724 | 4/1974 | Bartz | 270/61 F |
| 4,504,051 | 3/1985 | Bittner et al. | 270/40 |
| 4,559,031 | 12/1985 | Gysling et al. | 493/410 |
| 5,123,893 | 6/1992 | Grooms | 493/410 |

FOREIGN PATENT DOCUMENTS 58-51172 11/1983 Japan .

OTHER PUBLICATIONS

Research Disclosure Aug. 1991, No. 328, EN8900287.

*Primary Examiner*—Edgar S. Burr
*Assistant Examiner*—Lynn D. Hendrickson
*Attorney, Agent, or Firm*—Michael E. Belk

[57] ABSTRACT

Tractor drives of a high speed printer move a length of continuous-form paper longitudinally up from a box of fanfold stacked paper, through a print mechanism and downward for refolding onto a fanfold stack. A set of bead chains hang vertically from the printer frame on each respective side of the descending paper. The chains are positioned to interact with the folding paper. The chains swing against the paper to aid in creasing the paper at the folds in the proper fanfold direction. Each set of chains include an upper chain and a lower chain. The lower end of an upper chain hangs substantially above the lower end of a lower chain. The lower chain interacts with the folding paper at the beginning of stacking to aid in establishing the refolding stack and continues to interact to minimize jamming until the stack height exceeds a range for proper interaction with the lower chain. Then the upper chain interacts with the folding paper in a range of stack height up to the maximum operating stack height to reduce paper jams.

26 Claims, 2 Drawing Sheets

HIGH SPEED CONTINUOUS-FORMS PRINTER

TECHNICAL FIELD

This invention relates to high speed continuous-forms printing and, in particular, to jam-free, refold stacking of the continuous-forms subsequent to printing.

BACKGROUND OF THE INVENTION

Information handling systems utilize high speed printers for rapidly generating printed information in a tangible form. High speed printers generally utilize xerographic or impact printing technologies. Impact printers are selected where the option to print multipart forms is desired. The printing mechanism for impact printers generally transfers ink or other material from a print ribbon onto the paper to form images on one major surface of the paper.

Continuous-form paper is usually supplied from a box in which the paper is stacked in a fanfold pattern. The paper may be single layer or may be multi-layer to provide multi-part forms. Continuous-form paper is perforated along lateral lines for dividing the continuous length into separable rectangular sheets or forms. Each of the separable sheets is rectangular and is typically 11.5 inches high by 14 and $\frac{7}{8}$ inches wide. The paper is folded along the perforations in a zigzag manner reminiscent of oriental hand fans in which each lateral perforation is folded in the opposite direction from the preceding fold to form a stack.

Tractor drives engage a longitudinal row of holes along each edge of the paper for moving the paper longitudinally from the source box of paper, through the printing mechanism and downward toward a horizontal surface upon which it refolds into an output stack of printed, continuous forms. The tractor drives tend to distort the paper at the tractor holes in the edges of the paper so the refold stack is bowed upward at the edges. Typically, the paper length remains slightly folded along the lateral perforations after unstacking and printing and the descending paper length naturally tends to refold onto the stack at each lateral perforation in the same direction at it was originally folded.

In order to aid in establishing the proper initial stack position and fold direction of the refolding stack, some printers such as the IBM 3262 and IBM 6262, provide a set of multiple chains hanging from the printer frame on each respective side of the descending length of paper. The lower ends of all the chains extend down to hang approximately 4 inches above the platform on which the output forms is folded. In at least one case at least one of the chains on at least one of the sides of the paper is extended so that the end of the chain was substantially less than 4 inches above the platform. Once the stack is started in the proper location with the continuous length of paper refolding in the previous fold directions, proper refolding tends to continue without any additional aid. However, occasionally the paper fails to refold in the desired direction which produces an unfolded jumble of printed output, and if not detected in time the paper stops moving through the printer. These previous chain configurations do not prevent occasional output jams from occurring during printing.

Since the introduction of fanfold paper refolding, practitioners have faced the problem that occasionally the paper will fail to refold along the lateral perforations in the proper direction, resulting in an output paper jam. It is known that the jamming is related to the bowing of stack due to the tractor damage and to the height of the paper discharge above the top of the stack and is also related to the intermittent characteristics of feeding of the paper through the printer.

The longitudinal movement of the paper through the printer is not continuous. Usually the movement is stopped as each line is printed on the sheets. Also, the paper tends to move quickly through blank lines and even more quickly through blank pages. For a very high speed paper tractor, the paper output is often accelerated so that descending paper bends as it falls into the stack and fails to properly refold onto the stack.

Also, the printer does not usually operate continuously. The output typically consists of separate reports which are sent to the printer as desired so that the printer is idle for minutes or even for hours between jobs. In addition, information handling systems tend to be idle for long periods due to schedules of working shifts, weekends and holidays. The paper in the printer may be idle with a lateral perforation in a straightened configuration so as to forget the original fold direction at the perforation; or the paper may be idle in a bent configuration and retain the bend so that it does not properly refold onto the output stack.

In order to overcome this occasional jamming, practitioners have implemented many complex paper handling schemes. For example in U.S. Pat. No. 4,504,051 to Bittner et al. the height of a platform on which the printed output is stacked is automatically adjusted so that the distance from the paper output of the printer and the top of the stack remains about one half the height between the successive folds at the lateral perforations. FIG. 5 of that patent shows weighted beads or chain links on each side of the fanfold paper as it exits downward.

SUMMARY OF THE INVENTION

It is an object of this invention to provide a high speed continuous-forms printer which reliably and economically produces a refolded stack of printed fanfold output.

It is another object to provide a process for reliably and economically producing a refolded stack of printed continuous-forms fanfold output in a high speed printer.

It is another object of this invention to provide apparatus for reliable fanfold stacking over the entire range of stack height from the beginning of stacking until the maximum operating stack height.

It is another object of the invention to provide separate apparatus for reliable refolding onto a fanfold stack in each of multiple respective ranges of stack height.

In the applicant's invention the tractor drives of a high speed printer move a length of continuous-form paper longitudinally up from a box of fanfold stacked paper, through a print mechanism and downward for refolding onto a fanfold stack. A set of bead chains hang vertically from the printer frame on each respective side of the descending paper. The chains are positioned to interact with the folding paper. The chains swing against the paper to aid in creasing the paper at the folds in the proper fanfold direction. Each set of chains include an upper chain and a lower chain. The lower end of the upper chain hangs substantially above the lower end of a lower chain. The lower chain interacts with the folding paper at the beginning of stacking to aid in establishing the refolding stack and continues to interact to minimize jamming until the stack height exceeds a range for proper interaction with the lower chain. Then the upper chain interacts with the folding paper in a range of stack height up to the maximum operating stack height to reduce paper jams.

Other features and advantages of this invention will become apparent from the following detailed description of the presently preferred embodiment and alternative embodiments of the invention, taken in conjunction with the accompanying drawings.

DETAILED DESCRIPTION OF THE DRAWINGS

Figure 1:
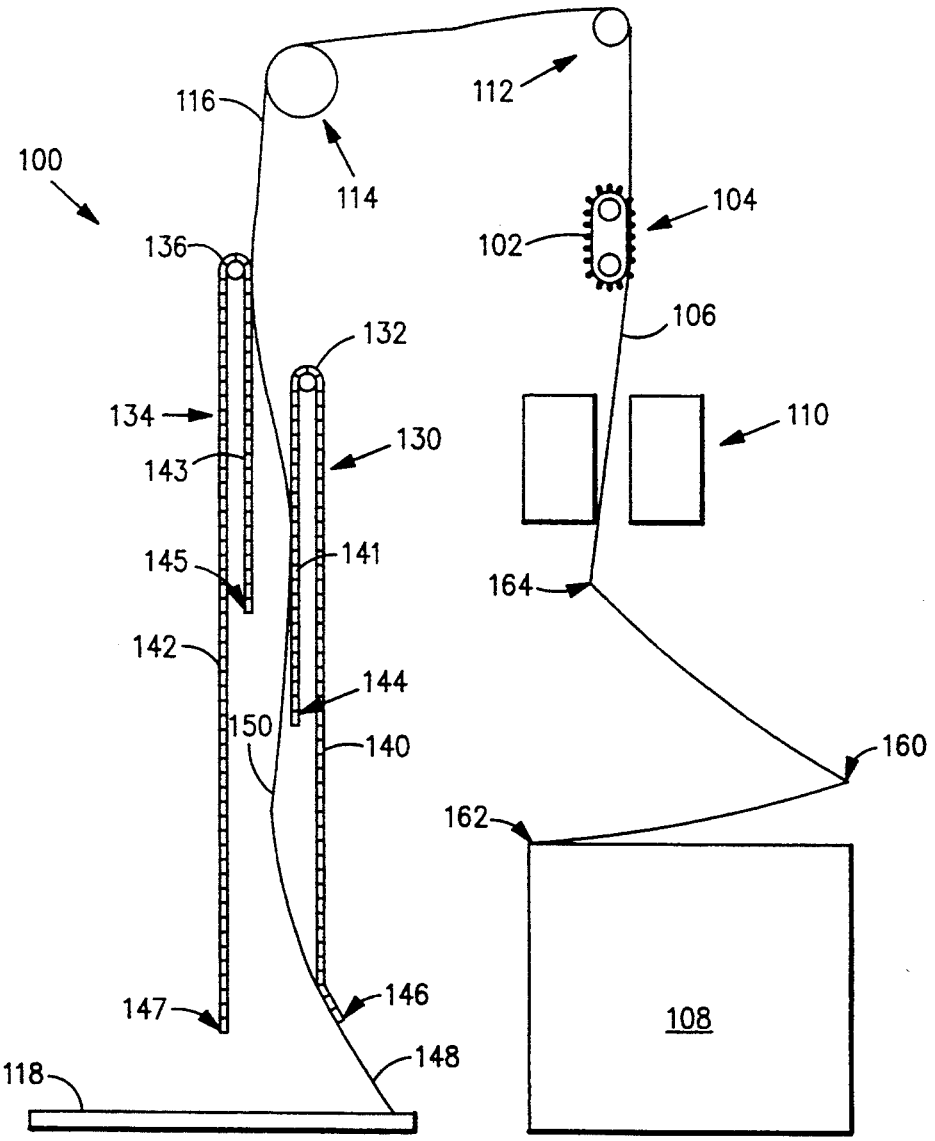
FIG. 1 schematically illustrates a side view of the printer of the invention with a set of chains vertically hanging on each major side of the descending length of refolding paper, each set having lower ends hanging down with two different heights above the platform on which the paper is refolded.

FIG. 1 schematically illustrates a side view of printer 100 of the invention. Pins 102 of tractor drive 104 engage into holes (not shown) on each longitudinal edge of a continuous-form length 106 of paper, to move the continuous paper longitudinally from a source 108 of fanfold paper, through printing mechanism 110, around paper deflection means 112 and 114, and downward at 116 toward generally horizontal surface 118 onto which the paper refolds in the same fanfold pattern as in the source. A set of smooth chains 130 on the front side 106 of paper hang vertically down from printer frame member 132; and similarly a set of chains 134 on the back side of the paper hang from printer frame member 136.

The chains usually comprise hollow metal beads on a string or wire, or small interlocking beads or any similar elongated member which does not catch the paper. The sets of chains interact with the folding length of paper. Front set of chains 130 include at least one lower chain 140 and at least one upper chain 141; similarly, back set of chains 134 also include at least one lower chain 142 and at least one upper chain 143. The lower ends 144,145 of upper chains 141,143 respectively are substantially higher above surface 118 than lower ends 146,147 of lower chains 140,142 respectively.

At the beginning of folding, as shown, the lower chains 140,142 position the paper stack symmetrically about the center between the chains. The paper pushes the lower chains outward to swing and the swinging chains sweep against sheets 148 and 150 to aid in refolding the continuous length of paper.

Source 108 of paper may be, for example, a cardboard box containing a paper stack folded at perforations. The pattern of the folds is similar to the pattern used in hand held oriental fans in which each fold 160 is bent, as shown, in the opposite direction in relation to previous fold 162 and subsequent fold 164.

Figure 2:
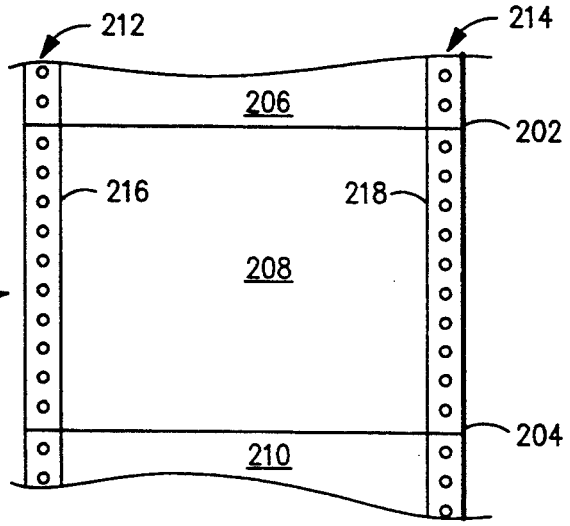
FIG. 2 shows a section of a major surface of the continuous-form length of paper of FIG. 1.

FIG. 2 illustrates a section of a major surface of the continuous-form length 200 of the paper of FIG. 1. The continuous length of paper is divided laterally by linear perforations 202 and 204 into sheets or forms 206, 208 and 210 which can be separated into single sheets by tearing along perforations 202 and 204. Rows of holes 212 and 214 along each longitudinal edge of the length of paper interact with tractor drives as described above. Typically, longitudinal perforations 216 and 218 are provided for removing the edge holes from the printed reports.

Figure 3:
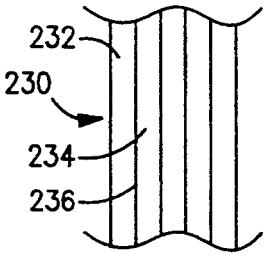
FIG. 3 is a view of a section of the edge the paper of FIG. 1 showing a multipart embodiment of the paper.

FIG. 3 is a view of a section of the edge of the continuous length 230 of paper of FIG. 1. This multipart form embodiment of the paper includes 5 layers of paper such as layers 232 and 234. Adjacent layers of paper such as 232 and 234 are separated by copy means such as 236 for simultaneous impact printing on all the layers. The copy means may include, for example, carbon paper or interactive chemical coatings on the adjacent paper surfaces.

Figure 4:
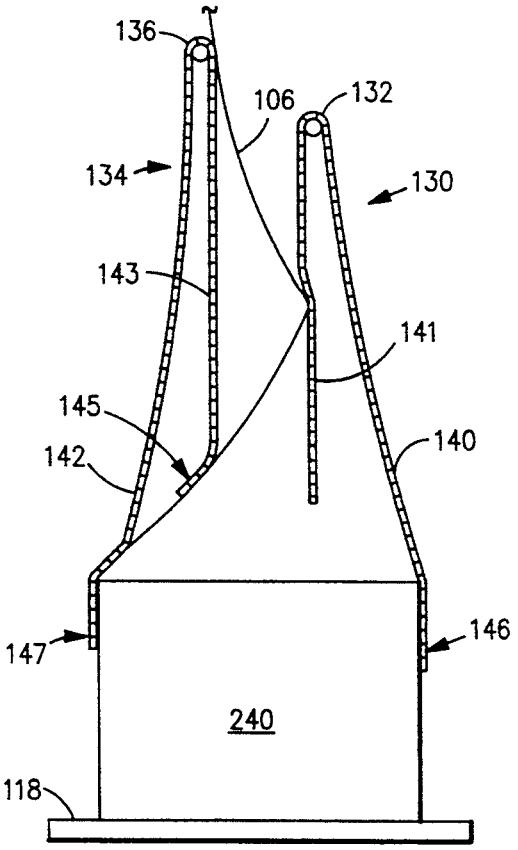
FIG. 4 is a schematic partial side view of the printer of FIG. 1 except the stack is higher so that the lower chains are inactively draped over the sides of the refolding stack and the upper chains are interacting with the surface of the folding length of paper.

FIG. 4 is another view of printer 100 of FIG. 1 utilizing the same labels except that the refolded stack 240 is much higher. The figure illustrates the interaction between the sets of chains 130, 134 and the folding length of continuous paper when the top of stack 240 is in a higher range above plane 118. Lower ends 146, 147 of lower chains 140, 142 are draped over the edges of stack 240, and lower chains no longer sweep against the folding paper. Upper chains 141 and 143 are sweeping against the folding length of paper as the paper pushes the chains and the chains swing back to bear against the upper surface of the paper.

Figure 5:
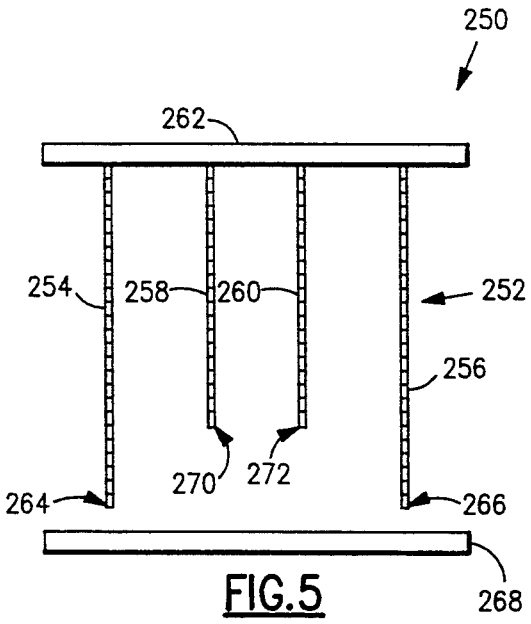
FIG. 5 is a schematic partial back view of the chains and platform of FIG. 1 showing one of the sets of chains hanging down from the printer frame above the platform.

FIG. 5 is a schematic partial back view of printer 250 of the invention showing one set 252 of chains. The set of chains include two upper chains 254 and 256 and two lower chains 258 and 260 hanging vertically down from printer frame 262. The lower ends 264 and 266 of lower chains 258 and 260 respectively each hang near the platform 268 to aid in properly locating and starting the folding of the paper on the platform. The lower ends 270 and 272 of upper chains 258 and 260 respectively are substantially above bottom ends 264,266 of lower chains 258,260 in order to prevent jamming as the stack height increases up to the maximum operating stack height.

Experiments with an IBM 3262 printer and 11.5 inches high by 14 and $\frac{7}{8}$ inches wide 15 pound paper in which the height of the lower ends of the chains were adjusted, indicate that the chains are substantially effective in reducing jams only when the stack height is within a range from about 6 inches below to about 6 inches above the bottom end of the chain. The chains are effective in minimizing jams when the stack height is within a range from about 4 inches below to about 3 inches above the bottom end of the chains. For example, if the maximum stack height during printer operation is 14 inches above table 268, then lower ends 264,266 of the lower chains may be positioned about 4 inches above platform 268 to minimize jams for stack height range from 0 to about 7 inches, and lower ends 270,272 of the upper chains positioned about 3 inches below the maximum stack height to minimize jams for stack height ranging from 7 inches up to the maximum operating height.

Figure 6:
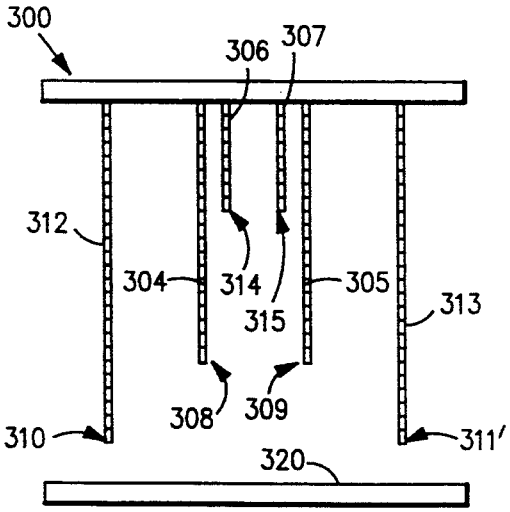
FIG. 6 is a schematic partial back view of another embodiment of the printer of this invention with chain ends hanging at three different heights above the platform.

FIG. 6 is a schematic partial back view of another embodiment of the printer 350 of this invention. FIG. 6 is similar to FIG. 5 except two pairs of upper chains hang from printer frame member 302 including a middle pair 304 and 305 and an upper pair 306 and 307. The chains are hung from 4 equally spaced hangers across the paper width and one upper and one middle chain are hung from each of the central two hangers. Middle pair of chains 304,305 have lower ends 308,309 respectively which hang substantially above lower ends 310,311 of lower chains 312,313 respectively. Upper pair of chains 306,307 have lower ends 314,315 respectively which hang substantially above lower ends 308,309 of the middle chains.

This configuration could be used, for example, to minimize jamming where the maximum operating stack height is between 14 and 21 inches above surface 320. For example, if the maximum stack height was 15 inches above surface 320, lower ends 310, 311 are positioned about 4 inches above surface 320, lower ends 314, 315 of the upper chains are positioned from 11 to 18 inches above surface 320, and lower ends 308 and 309 of the middle chains are positioned between the lower ends of the upper chains and lower ends of the lower chains and within 7 inches of the lower ends of both the upper and lower pairs of chains.

Figure 7:
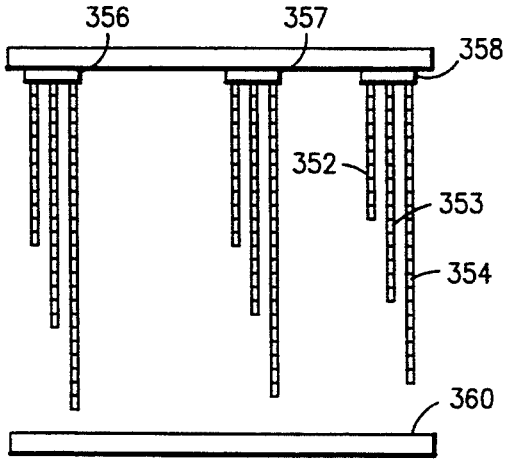
FIG. 7 is a schematic partial back view of the printer of this invention illustrating the currently preferred arrangement of the chains.

FIG. 7 is a schematic partial back view of the currently preferred arrangement of the chains of the printer 350 of the invention. Three different length chains typical of 352, 353, 354 hang from each of three hangers 356, 357, 358 which are equally spaced horizontally with each other and symmetrically positioned about the center of the stack (not shown). Typically, fanfold computer paper comes in boxes containing a stack which is 15 inches high which defines the maximum operating height of the output refolded stack. As described for FIG. 6 above, the three heights above table top 360 selected for the lower ends at each hanger are 4, 11 and 15 inches for chains 354,353 and 352 respectively.

While the currently preferred embodiment and alternate embodiments of this invention have been illustrated and described, various changes and modifications may be made therein within the scope of this invention which is defined by the following claims.

What is claimed is:

1. A printer comprising in combination:

means for supplying a length of continuous form paper which is prefolded laterally along linear performations which connect between sheets;

printing means for producing images on the surface of the length of paper;

tractor means for moving the length of paper longitudinally through the printing means and downward onto a fanfold stack after printing;

surface means including a fixed height platform for stacking perforation connected paper sheets thereon in a fanfold arrangement up to a maximum operating stack height; and control means for properly depositing and refolding the paper over an entire range of the stack height, said control means including a plurality of chains of different length for cooperating with the paper as it is stacked upon the platform.

2. The printer of claim 1 in which control means include:

a first chain with a lower end hanging in a first position above the platform to interact with the decending, folding length of paper to sweep against the paper for minimizing jamming for a first effective range of stack height extending at least from the start of stacking and up to a maximum effective stack height for effective interaction with the first chain; and a second chain with a lower end hanging in a second position above the platform to interact with the descending, folding length of paper to sweep against the paper for minimizing jamming for a second effective range of stack height range extending at least from the maximum effective stack height for effective interaction with the first chain up to a maximum operating stack height for the printer.

3. The printer of claim 1 in which control means include:

a first chain with a lower end hanging in a first position above the platform to interact with the decending, folding length of paper to sweep against the paper for minimizing jamming for a first effective stack height range extending at least from the start of stacking and up to a first maximum effective stack height for the first chain;

a second chain with a lower end hanging in a second position above the platform to interact with the decending, folding length of paper to sweep against the paper for minimizing jamming for a second effective stack height range extending from at least the first maximum effective stack height for the first chain up to a second maximum effective stack height for the second chain; and a third chain with a lower end hanging in a third position above the platform to interact with the decending, folding length of paper to sweep against the paper for minimizing jamming for a first effective stack height range extending from a least the second maximum effective stack height for the second chain up to a maximum operating stack height for the printer.

4. The printer of claim 1 in which control means include multiple chains effectivly interacting with the decending, folding paper for minimizing jams for each stack height in the entire range of stack height.

5. The printer of claim 1 in which at each stack height in the entire range of stack height at least two chains effectivly interact with each side of the decending, folding length of paper to sweep against the paper for minimizing jamming.

6. A printer comprising in combination:

a printing mechanism for producing images on the surface of a length of continuous form paper;

a tractor for moving the length of paper longitudinally up from a stack of paper laterally fanfolded at perforations between sheets, through the printing mechanism, and downward onto a fanfold stack after printing;

a fixed height platform upon which the connected sheets are stacked in a fanfold arrangement;

a frame extending accross the width of each major side of the decending length of paper;

a first set of multiple swinging chains hanging from the frame on one major side of the decending length of paper;

a second set of multiple chains hanging from the frame on the other major side of the decending length of paper;

and each of the sets of chains include:

a lower chain with a lower end hanging no more than 6 inches above the platform; and an upper chain with a lower end hanging above the lower end of the lower chain and from 10 inches below to 6 inches above a maximum operating stack height.

7. The printer of claim 6 in which for each of the sets of chains, the lower end of the upper chain is no more than 8 inches below the maximum operating stack height.

8. The printer of claim 6 in which for each of the sets of chains, the lower end of the upper chain is no more than 6 inches below the maximum operating stack height.

9. The printer of claim 6 in which for each of the sets of chains, the lower end of the upper chain is no more than 10 inches above the lower end of another chain.

10. The printer of claim 6 in which at least one of the sets of chains include:

multiple lower chains, each with a lower end hanging no more than 6 inches above the platform;

multiple upper chains, each with lower ends hanging from 6 inches below to 6 inches above the maximum operating stack height and no more than 10 inches above the lower end of any other chain in the set.

11. The printer of claim 6 in which:

the maximum operating stack height is approximatly 15 inches; and at least one of the sets of chains include:

a first chain with a lower end hanging from 0 to 5 inches above the platform;

a second chain with a lower end hanging from 5 to 15 inches above the platform and from 3 to 10 inches above the lower end of the first chain;

a third chain with a lower end hanging from 10 to 20 inches above the platform and from 3 to 10 inches above the lower end of the second chain.

12. The printer of claim 11 in which the set of chains include:

multiple first chains with a lower end hanging from 0 to 5 inches above the platform;

multiple second chains with a lower end hanging from 5 to 15 inches above the platform;

multiple third chains with a lower end hanging from 10 to 20 inches above the platform;

and in which the lower end of all of the chains in the set are no more than 10 inches above the lower end of any other chain in the set.

13. The printer of claim 12 in which the set of chains include:

at least two chains equally spaced accross the width of the paper and with a bottom end hanging about 4 inches above the platform;

at least two chains equally spaced accross the width of the paper and with a bottom end hanging about 11 inches above the platform;

at least two chains equally spaced accross the width of the paper and with a bottom hanging about 15 inches above the platform.

14. The printer of claim 11 further comprising:

three chain hooks attached to the printer frame and spaced approximatly equally and symetrically accross the width of each major surface of the decending length of paper, from each of which multiple chains hang including:

one chain with a lower end hanging approximatly 4 inches above the platform;

one chain with a lower end hanging approximatly 11 inches above the platform;

one chain with a lower end handing approximately 15 inches above the platform.

15. A fanfold paper stacker, comprising in combination:

surface means including a fixed height platform for stacking perforation connected paper sheets thereon in a fanfold arrangement up to a maximum operating stack height; and control means for properly depositing and refolding the paper over an entire range of the stack height, said control means including a plurality of chains of different length for cooperating with the paper as it is articles stacked upon the platform.

16. The paper stacker of claim 15 in which control means include:

multiple first chains with a lower end hanging from 0 to 5 inches above the plate;

multiple second chains with a lower end hanging from 5 to 15 inches above the plate;

multiple third chains with a lower end hanging from 10 to 20 inches above the plate;

and in which the lower end of all of the chains in the set are no more than 10 inches above the lower end of any other chain in the set.

17. A printing process comprising the steps:

supplying a length of continuous form paper which is prefolded laterally along linear perforations which connect between sheets;

printing images on the surface of the length of paper;

moving the length of paper longitudinally through printing means and downward onto a fanfold stack after printing;

stacking the perforation connected paper sheets on a fixed height platform in a fanfold arrangement up to a maximum operating stack height;

positioning a plurality of chains of different length for cooperating with the folding paper and positioning said plurality of chains so that the longest chains initially control the stacking of the paper and subsequently, as the paper stack grows, the shorter chains take over the function of controlling the stacking of the paper for minimizing jamming within the entire range of stack height between the start of stacking on the platform and the maximum operating stack height for the printer.

18. The process of claim 17 in which positioning chains includes the steps:

positioning a multitude of first chains with lower ends hanging in a first position range above the platform to interact with the decending, folding length of paper to sweep the first chains against the paper for minimizing jamming effectivly from the start of stacking and up to a first maximum effective stack height;

positioning a multitude of second chains with lower ends hanging in a second position range above the platform to interact with the decending, folding length of paper to sweep the second chains against the paper for minimizing jamming effectivly between the first maximum effective stack height for the first chain and a second maximum effective stack height; and positioning a multitude of third chains with lower ends hanging in a third position range above the platform to interact with the decending, folding length of paper to sweep the third chains against the paper for minimizing jamming between the second maximum effective stack height for the second chain and a maximum operating stack height for the printer.

19. The process of claim 18 in which:

the first position range for the lower ends of the first chains is from 0 to 5 inches above the platform;

the second position range for the lower ends of the second chains is from 8 to 13 inches above the platform;

the third position range for the lower ends of the third chains is from 13 to 18 inches above the platform.

20. The printer of claim 1 in which:

control means further include, frame means to position the chains along each major, lateral side of the descending length of paper and to position the chains, sufficiently near a central lateral axis of the stack for sweeping against upper surfaces of the refolding sheets to fold the perforations in a desired direction; and the chains include:

a first set of multiple chains hanging from said frame means on one major side of the descending length of paper; and a second set of multiple chains hanging from said frame means on a second major side of the descending length of paper;

for each chain to interact with the descending, folding length of paper for minimizing jamming within a limited effective range of stack height which is less than the entire range of stack height and in which the heights of boundaries of the effective range for each chain depends on the vertical position above the platform of a lower end of the chain; and each set of chains include chains having different effective ranges above the platform and are positioned for minimizing jamming within the entire range of stack height.

21. The printer of claim 15 in which:

control means further include, frame means to position the chains along each major, lateral side of the descending length of paper and to position the chains sufficiently near a central lateral axis of the stack for sweeping against upper surfaces of the refolding sheets to fold the perforations in a desired direction;

and the chains include:

a first set of multiple chains hanging from said frame means on one major side of the descending length of paper; and a second set of multiple chains hanging from said frame means on the other major side of the descending length of paper;

for each chain to interact with the descending, folding length of paper for minimizing jamming within a limited effective range stack height which is less than the entire range of stack height and in which the heights of boundaries of the effective range for each chain depends on the vertical position of a lower end of the chain; and each set of chains include chains having different effective ranges above the platform and positioned for minimizing jamming within the entire range of stack height.

22. The paper stacker of claim 15 in which control means include:

a first chain with a lower end hanging in a first position above the surface means to interact with the descending, folding length of paper to sweep against the paper for minimizing jamming for a first effective range of stack height extending at least from the platform up to a maximum effective stack height for effective interaction with the first chain; and a second chain with a lower end hanging in a second position above the plate to interact with the descending, folding length of paper to sweep against the paper for minimizing jamming for a second effective range of stack height range extending at least from the maximum effective stack height for effective interaction with the first chain up to a maximum operating stack height for the printer.

23. The paper stacker of claim 15 in which control means include:

a first chain with a lower end hanging in a first position above the plate to interact with the descending, folding length of paper to sweep against the paper for minimizing jamming for a first effective stack height range extending at least from the start of stacking and up to a first maximum effective stack height for the first chain;

a second chain with a lower end hanging in a second position above the plate to interact with the descending, folding length of paper to sweep against the paper for minimizing jamming for a second effective stack height range extending from at least the first maximum effective stack height for the first chain up to a second maximum effective stack height for the second chain; and a third chain with a lower end hanging in a third position above the plate to interact with the descending, folding length of paper to sweep against the paper for minimizing jamming for a first effective stack height range extending from a least the second maximum effective stack height for the second chain up to a maximum operating stack height for the printer.

24. The paper stacker of claim 15 in which control means include multiple chains effectively interacting with the descending, folding paper for minimizing jams for each stack height in the entire range of stack height.

25. The paper stacker of claim 15 in which for each stack height in the entire range of stack height at least two chains effectively interact with each side of the descending, folding length of paper to sweep against the paper for minimizing jamming.

26. The process of claim 17 in which positioning chains include:

hanging from a printer frame, a respective plurality of different length chains along each major side of the descending length of paper, above an area on the platform on which the paper is refolded, to sweep the chains against the refolding paper with each chain interacting with the descending, folding length of paper for minimizing jamming within a limited effective range of stack height which is less than the entire range of stack height and in which the height of the effective range for each chain depends on the vertical position of the chain, and each set of chains include chains having different vertical positions for the effective range of stack height and the chains are positioned for minimizing jamming within the entire range of stack height.

* * * * *